United States Patent [19]

Engel

[11] Patent Number: 4,772,993

[45] Date of Patent: Sep. 20, 1988

[54] ADJUSTABLE LAMP

[75] Inventor: Hartmut S. Engel, Freiberg am Neckar, Fed. Rep. of Germany

[73] Assignee: Brendel & Loewig Leuchtengesellschaft GmbH & Co. KG, Berlin, Fed. Rep. of Germany

[21] Appl. No.: 35,342

[22] Filed: Apr. 6, 1987

[30] Foreign Application Priority Data

Apr. 4, 1986 [DE] Fed. Rep. of Germany ..... 3611311

[51] Int. Cl.[4] ..... F21V 21/22; F21V 21/26

[52] U.S. Cl. ..... 362/419; 362/414

[58] Field of Search ..... 362/275, 413, 414, 418, 362/419

[56] References Cited

U.S. PATENT DOCUMENTS

| | | | |
|---|---|---|---|
| 1,255,185 | 2/1918 | Lehmkuhl | 362/414 X |
| 2,242,303 | 5/1941 | Irmischer | 362/418 X |
| 2,395,178 | 2/1946 | Fiori | 362/427 X |
| 4,280,172 | 7/1981 | Krogsrod | 362/285 X |
| 4,390,933 | 6/1983 | Warshawsky | 362/418 X |
| 4,525,773 | 6/1985 | Hesse et al. | 362/287 X |

FOREIGN PATENT DOCUMENTS

| | | | |
|---|---|---|---|
| 470449 | 4/1952 | Italy | 362/427 |

*Primary Examiner*—Tony M. Argenbright

[57] ABSTRACT

An adjustable lamp with a jointed boom is described which is pivotable about a vertical axis on a base part and which also has at least one pivot joint with a vertical axis. All pivot axes are simultaneously executed as electrical coaxial connections.

20 Claims, 5 Drawing Sheets

ADJUSTABLE LAMP

Figure 1:
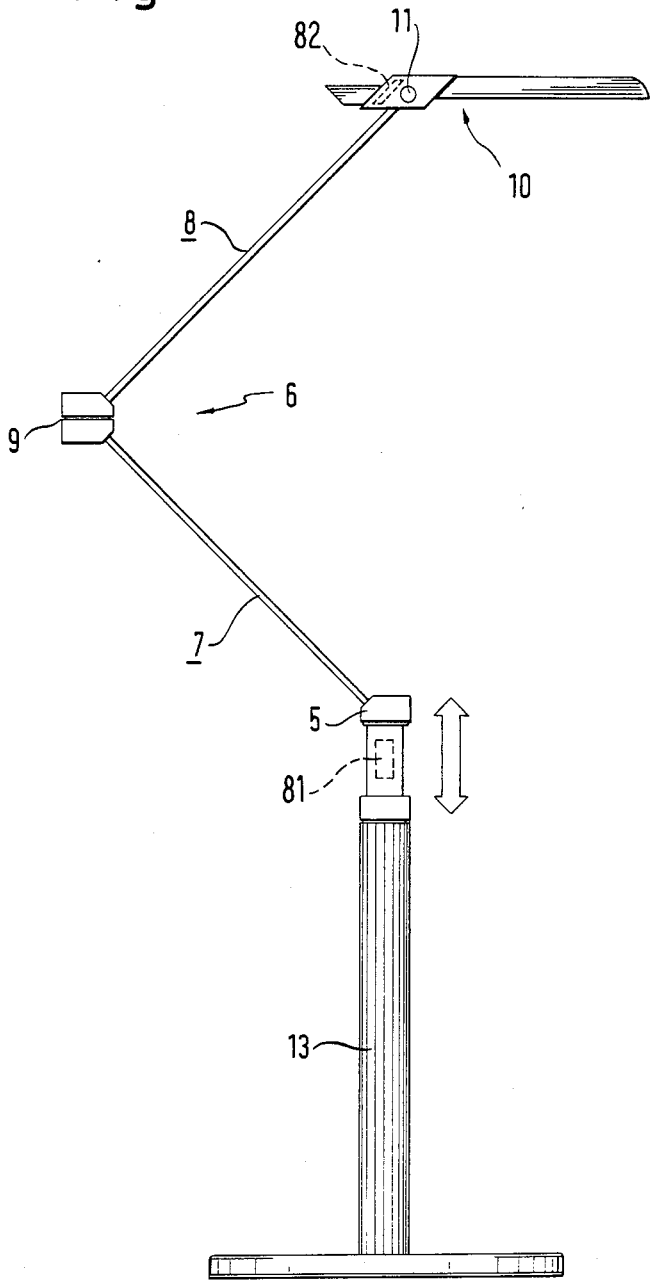

The invention relates to an adjustable lamp comprising a base part, a jointed boom and at least one lamp carrier.

Lamps of this kind are known in many forms as standing lamps, table lamps and wall lamps.

The object underlying the present invention is to develop a lamp of this kind in such a way that many adjustment possibilities are obtained while bridging an ideal range of heights. A further object of the invention is to provide a technically simple modular-like construction which can be packaged particularly compactly and which thus also ensures favourable storage, while making it possible to construct different lamp variants from the same basic units.

This object is satisfied in accordance with the invention in that the jointed boom is pivotally mounted on said base part at a first pivot joint for rotation about a first vertical pivot axis, and consists of at least two sections which have the same angle of inclination relative to the horizontal and are connected together at a second pivot joint, said pivot joint having a second vertical pivot axis; in that each section of the jointed boom is constructed of at least two parallel hollow rods which are firmly clamped at their ends; in that the or each lamp carrier is coupled with an end unit via a horizontal pivot axis; and in that respective electrical coaxial connections, preferably in the form of cartridges, are disposed at at least the first and second pivot joints with their axes coincident with said first and second pivot axes.

As a result of the simple and unproblematic separability of the coaxial connections one obtains modules which can be compactly packaged, but which in the assembled state make it possible to bridge an ideal range of heights. This is possible as a result of the vertical orientation of the pivot axes in conjunction with the ability to select different lengths for the hollow rod sections which are obliquely mounted relative to these axes. The coaxial connections which can be rotated through 360° permit the most diverse lamp positions.

A preferred embodiment of the invention is characterised in that the pivot joints with vertical pivot axes consist of at least two cylinder shaped heads which have substantially the same external contour and which engage in one another in a form and force locked manner via a ring recess and a projection which engages in this recess. This arrangement simultaneously relieves the electrical coaxial connection from tilting moments, and prevents separation of the two halves or heads. This variant of the embodiment is used in particular when, as a result of the selected dimensions, tilting moments act on the pivot joints which could otherwise lead to damaging loading of the coaxial connections.

In accordance with a further embodiment of the invention the base part of the lamp is mounted on the inner part of a telescopically extensible column of a stand. This inner part of the column is securable at different levels preferably by means of an eccentric clamping ring.

In this manner an additional degree of freedom of the adjustment is achieved, without the existing adjustment possibilities being impaired.

The lamp of the invention can be used both for operation at 220 V (110 V) and also for low voltage operation. A preferred use of the lamp takes place in conjunction with fluorescent bulbs which have a cap at only one side and which are arranged in lamp carriers of elongate shape. The bulbs may, for example, be shaded over half their periphery by the lamp carriers. Moreover, the lamp carriers can be mechanically and electrically mounted via a horizontally extending pivot axle provided at the end unit, preferably by being plugged onto the same. This ability to connect the parts in the manner of a plug and socket makes it possible to selectively use lamp carriers of different construction, i.e. differently equipped lamps and lamp structures can be assembled from the existing modules.

Further advantageous forms of the invention are set forth in the subordinate claims.

Figures 2, 2A:
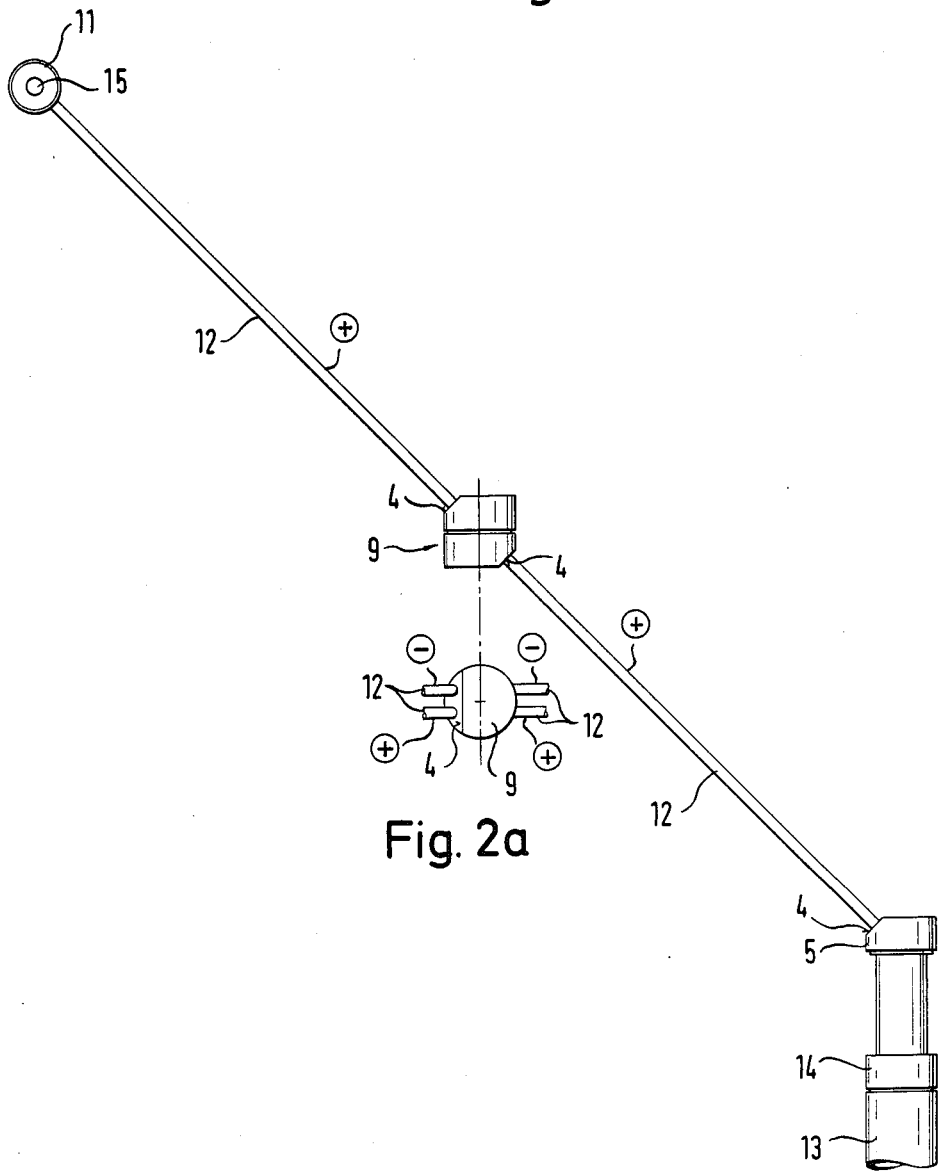
Figure 3:
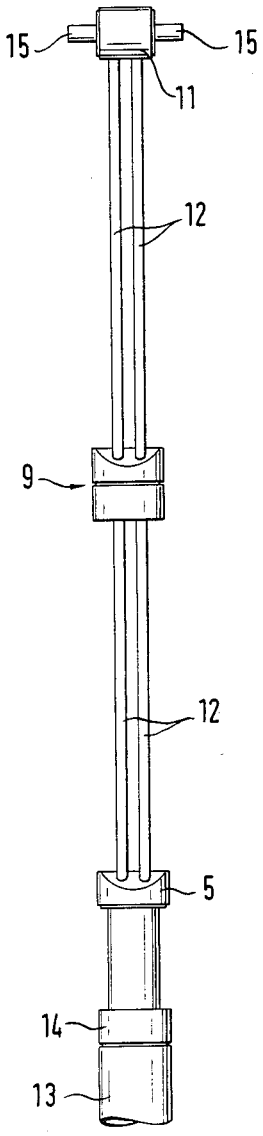
Figure 4:
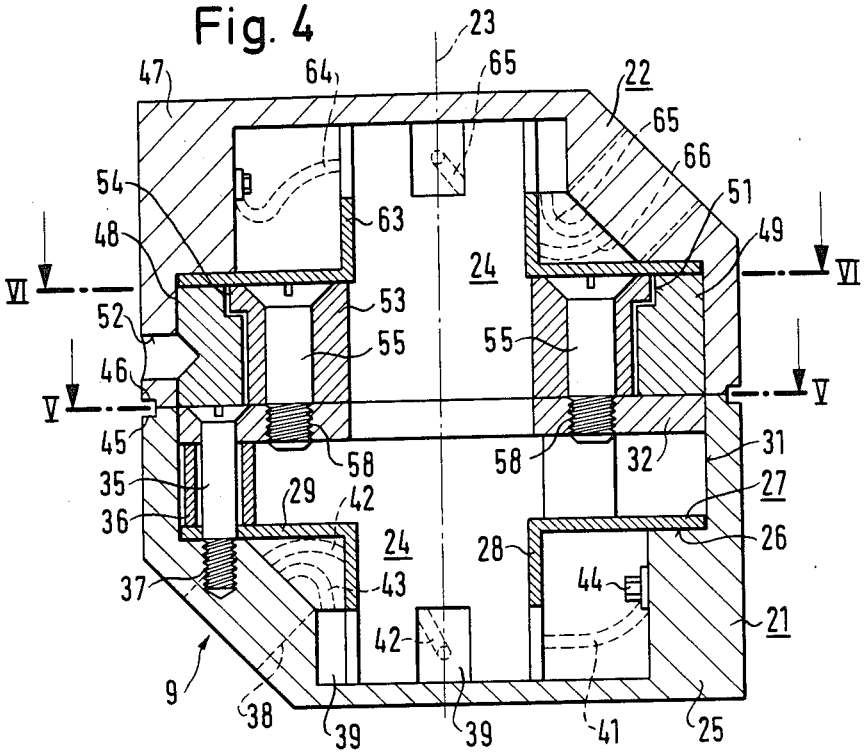
Figure 5:
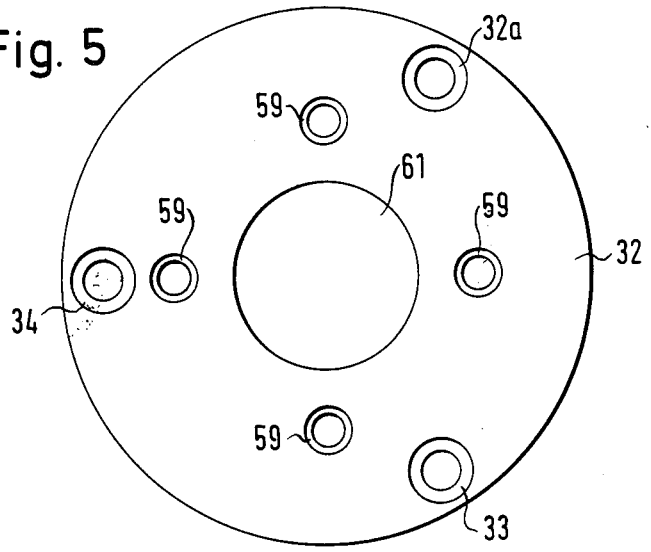
Figure 6:
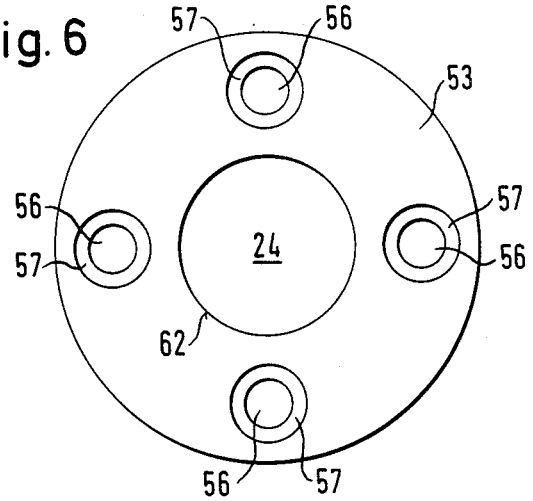
Figure 7:
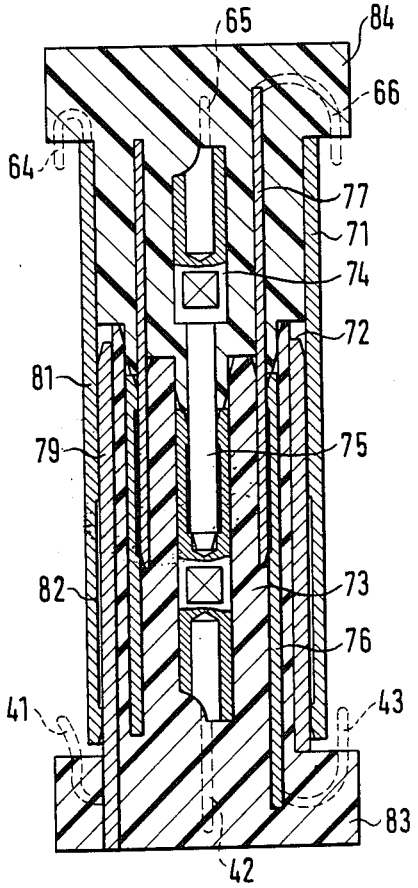

Embodiments of the invention will now be described in more detail with reference to the drawing which shows:

FIG. 1 a schematic representation of an adjustable lamp in accordance with the invention, in the form of a standing lamp embodiment, FIG. 2 a partial sideview of a jointed boom with FIG. 2*a* showing a plan view of the pivot joint, FIG. 3 an elevational view of the arrangement of FIG. 2, FIG. 4 a vertical cross-section through the pivot joint of FIG. 3, FIG. 5 a plan view of part of the pivot joint as seen in the direction V—V of FIG. 4, FIG. 6 a plan view of a further part of the pivot joint as seen in the direction VI—VI of FIG. 4, and FIG. 7 a longitudinal section through an coaxial connection cartridge for insertion into the pivot joint of FIG. 4.

The adjustable lamp of FIG. 1 includes a stand or pedestal 13 which is telescopically constructed and thus vertically adjustable and which is connected to a jointed boom 6 which is provided at its free end with at least one lamp carrier 10.

The base part 5 of the jointed boom 6 is secured to the vertically adjustable inner part of the pedestal 13, and indeed in such a way that the jointed boom 6 can be rotated via this base part 5 through 360° relative to the pedestal 13. This degree of pivotability can also be restricted in dependence on the particular purpose for which the lamp is intended.

The jointed boom 6 consists, in the illustrated embodiment, of two sections 7, 8 which are connected with one another via a pivot joint 9 which, in the same manner as the base unit 5, has a vertical pivot axis. This pivot joint 9 also preferably permits mutual pivoting of the sections 7, 8 over 360°.

At the top end of the section 8 there is provided a cylinder-shaped end unit 11. Plug-like coupling projections are provided at both end faces of the end unit and simultaneously form horizontally extending pivot axles for two lamp carriers 10 (only one shown) which are pivotable independently of one another. If desired only one lamp carrier need be used.

The portions 7, 8 preferably extend at an angle of 45° relative to the horizontal.

As a result of the possibility of pivoting two lamp carriers connected with the end unit 11 independently of one another it is possible, in conjunction with the general adjustability which results from the structure and its pivot joints, to solve very diverse lighting tasks in an ideal manner.

FIG. 2 shows the jointed boom of FIG. 1 in the extended position. The inner tube of the column 13 of the stand is extended somewhat and is fixed in this position by a clamping ring 14.

As can be seen from the elevational view of FIG. 3 two hollow rods 12 which extend parallel to one another are secured in the base part 5, and indeed in such a way that they subtend an angle of 45° with the horizontal. The base part 5 which has the general shape of a cylinder has an oblique chamfered surface 4 in the attachment region of the rods 12, which likewise has an inclination of 45°, so that the hollow rods 12 emerge at a right angle from this inclined surface 4.

The pivot joint 9 which is preferably centrally provided between the base part 5 and the end unit 11 has at least two parts rotatable relative to one another, with these parts corresponding to the base unit 5, at least from the point of view of their shape.

The end unit 11 is, as can be seen from FIGS. 2 and 3, constructed in the form of a cylinder fixedly secured to the hollow rods 12, with the cylinder being provided with plug axle projections at its two end faces. These plug axle projections 15 simultaneously represent electrical coaxial connections so that on plugging the respective lamp carrier into place the required electrical connections are established. The plug axle connetions 15 can be constructed simply as a tube member fixed to the end unit with a connection cartridge as per FIG. 7 disposed with one half within the tube member and the other half within the lamp carrier. The lamp carrier has a tubular recess which fits over said tube member.

The pivot joint 9 preferably consists of pressure die-cast parts which engage concentrically within one another and which are coupled in the axial direction by undercuts and by flange parts which engage in the corresponding recess. Simple releasability of this coupling can be achieved through the multipart construction which will be described later in more detail.

The central region of the two parts which are rotatable relative to one another is formed as a cylindrical region for accommodating an electrical coaxial connection. As a result of the form and force locked coupling of the two parts rotatable relative to one another the electrical coaxial connection can be attached in practically load-free manner. The connection lines are led into the hollow rods 12 and can be soldered to the inner and outer conductors of the coaxial connection or can be connected via suitable clamps.

The outer contour of the pivot joint is preferably covered over by cap parts which can be snapped into place, with these cap parts being unitarily executed and serving both for closing the two halves of the pivot joint and also for surrounding the base unit.

The electrical coaxial connection in the base unit 5 is executed in corresponding manner to the coaxial connection in the pivot joint 9. The two halves of the pivot joint and also the relatively rotatable parts of the base unit can be decoupled by the simple release of holding screws whereupon the electrical coaxial connection is then also releasable. Thus a total construction arises which is capable of being plugged together and which has important advantages from the point of view of the packaging, storage and transport of the lamp of the invention.

Turning now to FIGS. 4, 5 and 6 the construction of the pivot joint 9 will now be explained in more detail.

As seen in vertical cross-section in FIG. 4 the pivot joint 9 comprises two joint heads or halves 21 and 22 which are mutually rotatable about a vertical axis 23. The heads 21 and 22 are however secured together so that they cannot normally be separated from one another in the axial direction 23. The two heads 21 and 22 of the pivot joint 9 define a central generally cylindrical cavity 24 in which there is normally mounted a cylindrical coaxial connector cartridge, such as will be later explained in more detail with reference to FIG. 7, this cartridge has however been omitted from the drawing of FIG. 4 for the sake of clarity. The lower half 21 of the pivot joint 9 comprises an outer pressure die-cast housing 25 with an internal annular step 26 on which an inverted top hat element 27 sits, which can either be of plastic or of metal. The top hat element 27 has a basically cylindrical portion 28 with castellations at its lower end and a flange 29 which extends from the cylindrical portion 28 radially outwardly from the axis 23. The upper part of the housing 25 has a cylindrical recess 31 in which a circular plate 32 sits. This circular plate 32 can be seen in more detail in FIG. 5. It can be of metal or of plastic. The top surface of the plate 32 in FIG. 9 lies flush with the top edge of the lower half 25 of the housing. The plate 32 has three equidistantly spaced counter sunk holes 32, 33 and 34 near its periphery and is secured to the lower housing 25 by three counter sunk setscrews such as 35 (only one shown) which each pass through one of the counter sunk holes in the plate 32 through a respective tubular distance piece 36 and through an associated hole in the inverted top hat element 27. The threads 37 of the screws 35 engage in threaded bores in the lower housing 25. The outer peripheral edge of the inverted top head element 27 and the outer peripheral edge of the plate 32 are a comfortable sliding fit within the cylindrical recess formed in the top portion of the lower housing half 25, and this ensures that the lower half of the cylindrical chamber 24 is centered relative to the vertical pivot axis 23.

The lower half of the housing 25 also includes two parallel bores (only one of which is shown in phantom lines) also includes two parallel bores (only one of which is shown in phantom lines 48 in FIG. 4) into which the two hollow rods 12 are fitted. They can conveniently be retained by clamping grub screws or can simply be screwed into place. The lower half of the drawing of FIG. 4 also shows recesses 39 which are aligned with the gaps of the castellations in the bottom of the inverted top head element 27 and which serve to receive corresponding lugs formed on the bottom of the coaxial cartridge of FIG. 7. Also shown in phantom lines in the bottom half of FIG. 4 are electrical leads 41, 42 and 43 of which 42 and 43 can be regarded as the AC power supply lines and 41 is the earth line which is connected to the lower half of the housing via a set screw 44. The lines 42 and 43 enter into the lugs of the coaxial cartridge in a manner which will be described later.

Also evident in the lower half of the drawing of FIG. 4 is a small annular step 45 at the top of the lower half 21 of the housing 25. This annular step 45 cooperates with a similar annular step 46 at the bottom of the top half 22 of the pivot joint 9 to form an external annular groove which improves the appearance of the pivot joint. The top half 22 of the pivot joint also has a pressure die-cast outer housing 47 which is essentially identical to the lower housing 25 and is indeed made in the same mould. The upper housing 47 has a downwardly facing cylindrical recess 48 corresponding to the cylindrical or annular recess 31 of the lower housing part and this recess accommodates a ring member 49 which has an internal outwardly projecting annular step 51 at it top end in FIG. 4. The ring 49 is secured to the upper housing half 47 by one or more grub screws which engage through threaded bores such as 52. The ring is again a comfortable sliding fit within the upper housing half 47 of the pivot joint 9. Within the ring member 49, which may be of metal or of plastic, there is located a generally cylindrical member 53, which is also separately illustrated in plan view in FIG. 6. The cylindrical member 53 has an outwardly directed annular flange 54 which is of complementary shape to the annular step or groove 51 formed in the ring member 49. The cylindrical member is secured to the plate 32 by four counter sunk setscrews 55 which extend through four equispaced bores 56 formed in the cylindrical member 53. Countersinks 57 are formed in the top surface of the cylindrical member 53 at the entry to each bore 56, thus forming a generally conical surface for receiving the counter sunk head of each of the screws 55. In this way the counter sunk heads of each of the screws 55 cooperated with the countersinks 57 to center the cylindrical member 53 so that the part of the cylindrical chamber 24 defined within the circular segments is also coaxial with the bore 23. This centering need not necessarily be achieved by the counter sunk heads of the screws, it could for example equally be achieved the shanks of the screws. It will be noted that the threaded portions 58 of the counter sunk screws 55 engage in threaded bores in the plate 32 so that they can be screwed into this plate once the lower half of the housing has been assembled. The four threaded bores which accommodate the four counter sunk screws 55 can also readily be seen in FIG. 5. Moreover it will be noted that the central circular aperture 61 in the plate 32 lies flush with the inner cylindrical surface 62 of the cylindrical member 53. The cylindrical member 53 can again be manufactured in metal or in plastic as desired. Above the cylindrical member 53 there is located a further top hat element 63 which is identical in all respects to the lower top hat element 27. Again the cylindrical portion has castellations at its free end which serve to accommodate lugs formed on the coaxial cartridge of FIG. 7. Moreover leads 64, 65 and 66 corresponding to leads 41, 42 and 43 can also be seen in the top half of the pivot joint of FIG. 4. It will be noted that the form-locked connection of the ring member 49 with the cylindrical member 53, the top hat element 63 and the plate 32 defines the mutually rotatable surfaces of the pivot joint. The fact that the cylindrical member 53 has an outwardly projecting annular flange 54 which engages in the correspondingly shaped recess of outer ring member 49 prevents the two halves of the joint from being separated.

The cartridge which fits within the central cylindrical chamber 24 of the pivot joint 9 of FIG. 4 is shown in longitudinal section in FIG. 7. In this case the coaxial cartridge is executed as a three wire cartridge, its design could however be simplified to that of a two wire cartridge in the event that a low voltage bulb is used, or electrical regulations permit.

The cartridge consists of two coaxially disposed parts 71 and 72 each of which consists of three coaxial conductors (shown by single diagonal hatching) separated by sleeves of insulating material (shown by cross-hatching). More specifically the lower half 72 of the cylindrical cartridge contains a central metallic conducting socket member 73 which is connected to the live feedline 42 and which receives the central projecting metallic conducting pin member 74 of the top end 71 of the cartridge. The region 75 over which the central pin engages the central socket ensures a flow of current from the lead 42 to the lead 65 which is attached to the central pin. The region 75 may include a spring member which resiliently engages both the pin 74 and the socket 73. Such a spring is schematically illustrated by the black lines at 75. A second electrical path is defined between the intermediate tubular conductor 76 of the lower part of the cartridge and the similar cylindrical intermediate member 77 of the upper part of the cartridge. The lower tubular member 76 is connected to the lead 43 and the upper tubular member 77 which fits within it is connected to the lead 66. The tubular member 77 and 76 are coaxial with the pin 74 and socket members 73.

In addition the lower half of the coaxial cartridge has a tubular member 79 which engages within the outer cylindrical member 81 of the upper half of the cartridge and defines a further electrical contact region 82 between the two tubular members. Once again this region 82 can include a spring to ensure electrical continuity. The lower tubular member 79 is connected to the earth lead 41 while the upper tubular member 81 is connected to the further earth lead 64. It will be noted that the leads 41, 42, 43 and 64, 65, 66 are led out of the upper and lower sides respectively of lugs 83 and 84 formed on the insulation at the top and bottom of the coaxial cartridge. These lugs of the cartridge engage in the recesses of the joint heads through the castellations in the top hat elements 27 and 63.

The joint is assembled as follows:

First of all the lower half 72 of the cyindrical cartridge is inserted through the inverted top hat element 27 from beneath so that the lugs engage within the castellations. Th earth lead 41 is then attached via the screw 44 to the lower housing half 25 and connection is established between the further leads 42 and 43 with the leads coming up through the hollow rods of the lower section of the jointed boom, these rods having been previously screwed into the bores 38 in the lower half of the housing. Once the connections have been made the lower top hat element 27 is seated on the annular step 26 in the bottom half of the housing, the three distance pieces 36 are then set over the holes in the top hat element 27, the plate 32 is placed on top of the distance pieces and the screws 35 are inserted and screwed tight into the bores in the housing. The ring 49 is then placed on top of the plate 32 and the cylindrical member 53 is inserted and screwed tight to the plates 32 by means of the screws 55. The top half of the coaxial cartridge is then inserted into the top hat element 63 in similar manner to that in which the bottom half of the cartridge is inserted into the top hat element 27 and the leads 64, 65, 66 are connected to the leads which pass on to the lamp and to the upper housing 47. The upper housing with the top hat element 27 is then set over the ring member 48 and the grub screws within the bores 52 are tightened to clamp the ring member 52 to the upper housing 47 and thus complete the pivot joint 9. It will be appreciated that the hinged joint between the lower section of the pivoted boom and the vertical column can be executed in similar manner. It will be noted that the coaxial cartridge is fully enclosed and cannot come apart. The upper and lower halves of the coaxial cartridge can however rotate freely relative to one another on rotation of the joint. The design of the joint with the mechanical bearing surfaces between the parts 53, 32, 49 and 63 however prevent the coaxial cartridge from being loaded in bending.

If the lamp is a fluorescent lamp a choke 81 may be arranged in the column 13, and a starter 82 in the lamp carrier (FIG. 1). In the case of a low voltage lamp the hollow rods can be directly used as the electrical conductors, as is indicated by the plus and minus signs in FIGS. 2 and 2*a*.

I claim:

1. An adjustable lamp comprising: a base part, a jointed boom, and at least one lamp carrier; said jointed boom being pivotally mounted on said base part at a first pivot joint for rotation about a first vertical pivot axis, and comprising at least two sections having an identical angle of inclination relative to the horizontal and being connected together at a second pivot joint having a second vertical pivot axis; each section comprising at least two parallel hollow rods having ends which are firmly clamped together; said at least one lamp carrier being coupled with an end unit via a horizontal pivot axis; and respective electrical coaxial connectors disposed at at least said first and second pivot joints with axes coincident with said first and second pivot axes.

2. A lamp in accordance with the claim 1, wherein said second pivot joint comprises first and second heads which have substantially the same external contour and are disposed one above the other; said first head having a cylindrical member with an annular projection which engages in a complementary recess in said second head, to thereby permit relative rotation of said first and second heads about said second vertical axis but preventing axial separation thereof.

3. A lamp in accordance with claim 2, wherein each head is of generally cylindrical shape having an oblique chamfered surface, said oblique chamfered surfaces forming attachment surfaces for said hollow rods.

4. A lamp in accordance with claim 2, wherein said first and second heads both define a bore extending coaxial to said second vertical axis for accommodating a coaxially disposed connection cartridge forming said electrical coaxial connection, said cartridge having first and second halves which are rotatable relative to one another.

5. A lamp in accordance with claim 4, wherein said cartridge is relieved of tilting moments by said cylindrical member and said complementary recess, the interengagement of which substantially pervents tilting of said first head relative to said second head.

6. A lamp in accordance with claim 4, wherein said first and second heads define walls at respective ends of said bore for preventing axial movement of said cartridge.

7. A lamp in accordance with claim 4, wherein said first head comprises an outer housing having a recess therein defining an internal step, an inverted top-hat element having a sleeve portion defining part of said bore and a flange seated on said internal step, a plate member having a central aperture inserted in said recess above said inverted top-hat element, screw means securing said plate member and said top-hat element to said housing, said cylindrical member being mounted on said plate member; said second head comprising a ring defining said annular recess positioned adjacent said plate member surrounding said cylindrical member, an upright top-hat element having a sleeve portion defining part of said bore and a flange positioned above said ring, a second outer housing enclosing said top-hat element and said ring, and means releasably securing said second outer housing to said ring.

8. A lamp in accordance with claim 4, wherein each of said first and second cartridge halves comprises a plurality of concentrically disposed, insulating, cylindrical sleeves and conductors, the sleeves and conductors of said first cartridge half being complementary in shape to the sleeves and conductors of the second cartridge half and interengaging therewith to form at least two distinct conductive connections which are electrically insulated from one another.

9. A lamp in accordance with claim 7, wherein respective lead contacting conductors of said first and second cartridge halves emerge from the respective cartridge halves through radially projecting lugs at opposite ends of said cartridge; said lugs engaging through respective openings in said top-hat elements into recesses in said housings, whereby said cartridges can be electrically connected to leads extending through said sections of said jointed boom.

10. A lamp in accordance with claim 1, wherein said angle of inclination is 45°.

11. A lamp in accordance with claim 1, wherein said pivot joints are pivotable over at least 360°.

12. A lamp in accordance with claim 1, wherein said base part consists of identically constructed first and second heads and is coupled with one of: a column, a base plate, a wall, and a ceiling fastening unit.

13. A lamp in accordance with claim 1, wherein said base part consists of identically constructed first and second halves, and is coupled to a column, said column being telescopically extendible and having outer and inner parts; said base part being attached to said inner part of said telescopically extendible column.

14. A lamp in accordance with claim 13, comprising a clamping ring for securing said inner part of said column at different heights.

15. A lamp in accordance with claim 1, wherein said end unit is a cylinder with a horizontally disposed axis, and comprising plug axles at both end faces of said end unit for mechanical and electrical coupling of lamp carriers.

16. A lamp in accordance with claim 1, wherein said lamp carrier is formed to receive a fluorescent lamp having a cap at at least one end.

17. A lamp in accordance with claim 16, wherein a choke for said fluorescent lamp is arranged in a column coupled to said base part, and a starter associated with said choke is arranged in said lamp carrier.

18. A lamp in accordance with claim 1, wherein said sections which form said jointed boom are of different lengths.

19. A lamp in accordance with claim 1, wherein said lamp carrier is formed to receive a low voltage lamp, said hollow rods forming electrical conductors to receive said low voltage lamp.

20. A lamp in accordance with claim 1, wherein said respective coaxial connections are connection cartridges.

* * * * *